US008025072B2

(12) United States Patent
Atkinson et al.

(10) Patent No.: US 8,025,072 B2
(45) Date of Patent: Sep. 27, 2011

(54) DEVELOPING A FLOW CONTROL SYSTEM FOR A WELL

(75) Inventors: Colin Atkinson, Middlesex (GB); Franck B. G. Monmont, Caldecote (GB); Alexander F. Zazovsky, Houston, TX (US); Mark H. Fraker, Houston, TX (US); Qing Yao, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1235 days.

(21) Appl. No.: 11/643,049

(22) Filed: Dec. 21, 2006

(65) Prior Publication Data

US 2008/0149203 A1 Jun. 26, 2008

(51) Int. Cl.
*G06G 7/48* (2006.01)
*F17D 3/00* (2006.01)

(52) U.S. Cl. ..... 137/1; 703/10; 702/12

(58) Field of Classification Search ..... 137/1, 8, 137/9; 166/336, 244.1; 700/281, 282; 702/100, 702/45, 12; 703/10, 2
See application file for complete search history.

(56) References Cited

U.S. PATENT DOCUMENTS 5,269,376 A 12/1993 Gadelle et al.
5,355,953 A 10/1994 Shy et al.
5,435,393 A 7/1995 Brekke et al.
5,730,223 A 3/1998 Restarick
5,803,179 A 9/1998 Echols et al.
5,881,809 A 3/1999 Gillespie et al.
5,896,928 A 4/1999 Coon
5,906,238 A 5/1999 Carmody et al.
6,112,815 A 9/2000 Bøe et al.
6,112,817 A 9/2000 Voll et al.
6,276,458 B1 8/2001 Malone et al.
6,282,452 B1 8/2001 DeGuzman
6,343,651 B1 2/2002 Bixenman
6,371,210 B1 4/2002 Bode et al.
6,533,038 B2 3/2003 Venning et al.
6,589,791 B1 * 7/2003 LaBudde et al. ..... 436/55
6,622,794 B2 9/2003 Zisk, Jr.
6,644,412 B2 11/2003 Bode et al.
6,745,843 B2 6/2004 Johnson et al.
6,786,285 B2 9/2004 Johnson et al.
6,834,212 B1 * 12/2004 Patel et al. ..... 700/121
6,851,560 B2 2/2005 Reig et al.

(Continued)

FOREIGN PATENT DOCUMENTS

EP 0 588 421 9/1993

(Continued)

OTHER PUBLICATIONS

Cameron White, et al., "Controlling Flow in Horizontal Wells", World Oil, pp. 73-80 (Nov. 1991).

(Continued)

*Primary Examiner* — Kevin Lee
(74) *Attorney, Agent, or Firm* — Jim Patterson; Kevin B. McGoff; Rodney Warfford

(57) ABSTRACT

To develop a flow control system for use in a well, a multi-level approach is used, where the multi-level approach includes setting goals for the flow control system. According to the goals set, an overall design of the flow control system is specified, and based on the specified overall design for the flow control system, operation of the flow control system is simulated.

16 Claims, 4 Drawing Sheets

U.S. PATENT DOCUMENTS

| | | | | |
|---|---|---|---|---|
| 6,857,475 | B2 | 2/2005 | Johnson | |
| 6,857,575 | B2 | 2/2005 | Mathias et al. | |
| 6,883,613 | B2 | 4/2005 | Bode et al. | |
| 6,899,176 | B2 | 5/2005 | Hailey, Jr. et al. | |
| 7,114,511 | B2 * | 10/2006 | Lull et al. | 137/1 |
| 7,266,476 | B2 * | 9/2007 | Coburn et al. | 702/183 |
| 7,308,941 | B2 * | 12/2007 | Rolovic et al. | 166/312 |
| 2002/0177955 | A1 | 11/2002 | Jalali | |

FOREIGN PATENT DOCUMENTS

| | | |
|---|---|---|
| GB | 2325949 | 12/1998 |
| GB | 2376970 | 12/2002 |
| WO | WO 02/075110 | 9/2002 |
| WO | WO 03/023185 | 3/2003 |
| WO | 03072907 | 9/2003 |
| WO | WO 2004/018839 | 3/2004 |
| WO | WO 2004/113671 | 12/2004 |

OTHER PUBLICATIONS

C. Atkinson, et al. "Flow Performance of Horizontal Wells with Inflow Control Devices", European Journal of Applied Mathematics, vol. 15, issue 04, pp. 409-450 (Aug. 2004).

"EQUALIZER™ Production Enhancement System", Baker Oil Tools, Baker Hughes Inc., Pub. No. BOT-04-7761 4M (Jun. 2005).

"Application Answers: Combating Coning by Creating Even Flow Distribution in Horizontal Sand-Control Completions", Weatherford International Ltd. (2005).

Ben J. Dikken, "Pressure Drop in Horizontal Wells and Its Effect on Production Performance", SPE 19824, pp. 1426-1433, pp. 569-574, Society of Petroleum Engineers (Nov. 1990).

M.J. Landman, et al., "Optimization of Perforation Distribution for Horizontal Wells", SPE 23005, pp. 567-576, Society of Petroleum Engineers (1991).

A.N. Folefac, et al., "Effect of Pressure Drop Along Horizontal Wellbores on Well Performance", SPE 23094, pp. 549-560, Society of Petroleum Engineers (1991).

B.P. Marrett, et al., "Optimal Perforation Design for Horizontal Wells in Reservoirs with Boundaries", SPE 25366, pp. 397-406, Society of Petroleum Engineers (1993).

Kristian Brekke, et al., "A New Modular Approach to Comprehensive Simulation of Horizontal Wells", SPE 26518, pp. 109-123, Society of Petroleum Engineers (1993).

Fikri J. Kuchuk, et al., "Performance Evaluation of Horizontal Wells", SPE 39749, pp. 231-243, Society of Petroleum Engineers (1998).

Hong Yuan, et al., "Effect of Completion Geometry and Phasing on Single-Phase Liquid Flow Behavior in Horizontal Wells", SPE 48937, pp. 93-104, Society of Petroleum Engineers (1998).

Yula Tang, et al., "Performance of Horizontal Wells Completed with Slotted Liners and Perforations", SPE 65516, pp. 1-15, Society of Petroleum Engineers/PS-CIM International Conference on Horizontal Well Technology (1991).

Terje Moen, et al., "A New Sand Screen Concept. No Longer the Weakest Link of the Completion String", SPE 68937, pp. 1-10, Society of Petroleum Engineers (2001).

Jody R. Augustine, "An Investigation of the Economic Benefit of Inflow Control Devices on Horizontal Well Completions Using a Reservoir-Wellbore Coupled Model", SPE 78293, pp. 1-10, Society of Petroleum Engineers (2002).

D.S. Qudaihy, et al., "New-Technology Application to Extend the life of Horizontal Wells by Creating Uniform-Flow-Profiles: Production Completion System: Case Study", SPE/IADC 85332, pp. 1-5, Society of Petroleum Engineers/International Association of Drilling Contractors (2003).

K.H. Henriksen, et al., "Integration of New Open Hole Zonal Isolation Technology Contributes to Improved Reserve Recovery and Revision in Industry Best Practices", SPE 97614, pp. 1-6, Society of Petroleum Engineers (2005).

J.C. Moreno, et al., "Optimized Workflow for Designing Complex Wells", SPE 99999, pp. 1-8, Society of Petroleum Engineers (2006).

Sada D. Joshi, *Horizontal Well Technology,* Chapter 10, "Pressure Drop Through a Horizontal Well", pp. 379-382, 388-396, 404-407, 412-414, PennWell Books, PennWell Publishing Co., Tulsa, OK (1991).

ResFlow,Reslink, http://www.reslink.com/products3.html (2003).

ResFlow: Well Production Management System, Reslink (2005).

Equalizer Production Management System, Baker-Hughes, Baker Oil Tools (nd).

* cited by examiner

DEVELOPING A FLOW CONTROL SYSTEM FOR A WELL

TECHNICAL FIELD

The invention relates generally to developing a flow control system for a well.

BACKGROUND

A well (e.g., a vertical well, near-vertical well, deviated well, horizontal well, or multi-lateral well) can pass through various hydrocarbon bearing reservoirs or may extend through a single reservoir for a long distance. A technique to increase the production of the well is to perforate the well in a number of different zones, either in the same hydrocarbon bearing reservoir or in different hydrocarbon bearing reservoirs.

An issue associated with producing from a well in multiple zones relates to the control of the inflow of fluids into the well. In a well producing from a number of separate zones, in which one zone has a higher pressure than another zone, the higher pressure zone may produce into the lower pressure zone rather than to the earth surface. Similarly, in a horizontal well that extends through a single reservoir, zones near the "heel" of the well (the zones nearer the earth surface) may begin to produce unwanted water or gas (an effect referred to as water or gas coning) before those zones near the "toe" of the well (zones further away from the earth surface). Production of unwanted water or gas in any one of these zones may require special interventions to be performed to stop production of the water or gas.

To address water coning or gas coning effects, inflow control devices are used to control pressure drop and flow rates in the various zones of the well. However, the overall design of a completion system that includes such inflow control devices can be complex and can be affected by various characteristics and parameters. Conventional techniques of designing a completion system having inflow control devices suffer from various drawbacks.

SUMMARY

In general, a multi-level technique or approach of developing a flow control system is provided. The various levels of the multi-level technique base the development of the flow control system on different types of factors and considerations to provide a more comprehensive and analytic approach to developing such flow control system.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

In accordance with some embodiments, a multi-level technique or approach is provided to develop a flow control system that includes flow control devices. In some embodiments, the multi-level technique includes three levels: a top level for making strategic decisions to set goals for the flow control system; a middle level to make tactical decisions to select the general flow control system equipment design capable of accomplishing the goals; and a bottom level to model and simulate fluid flow to configure flow control system equipment based on a target flow profile (inverse problem) or to determine a fluid flow profile based on a target flow control system equipment profile (forward problem).

Figure 1:
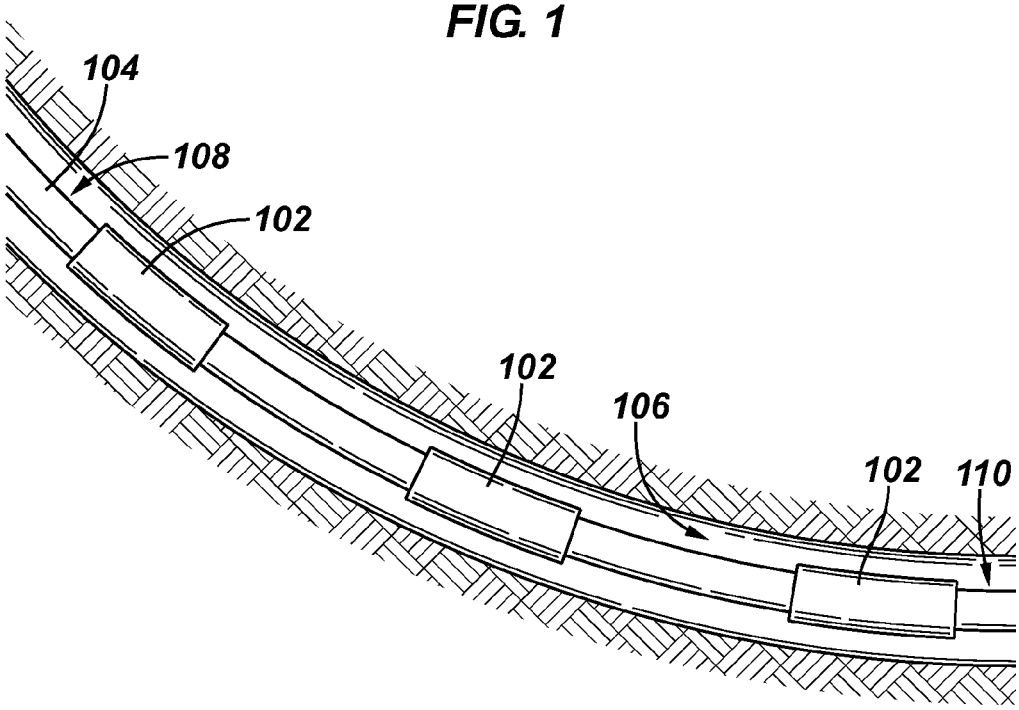
FIG. 1 illustrates an example arrangement of a flow control system including flow control devices developed using a multi-level technique or approach according to some embodiments.

FIG. 1 illustrates an example arrangement of a flow control system that includes flow control devices 102 that are coupled to a tubing string 104, which can be a production tubing string for producing hydrocarbons or other fluids from surrounding reservoir(s), or an injection tubing string to enable the injection of fluids into surrounding reservoirs(s). The flow control devices 102 are depicted as being located in a horizontal wellbore 106 which has a heel 108 and a toe 110. The flow control devices 102 are used to manipulate the flow profile (production flow profile or injection flow profile) between the wellbore 106 and surrounding reservoir(s) so that a desired pressure drop profile and production or injection fluid flow rate profile can be achieved to reach a target technology or business goal.

In the ensuing discussion, reference is made to production of fluids from reservoir(s) into a wellbore. However, similar techniques can be applied in the injection context.

As noted above, to develop a flow control system that includes flow control devices in accordance with some embodiments, a multi-level technique is employed, where the multi-level technique includes a top-level procedure, a middle-level procedure, and a bottom-level procedure. Other embodiments of the multi-level technique can include other numbers of levels.

Figure 2:
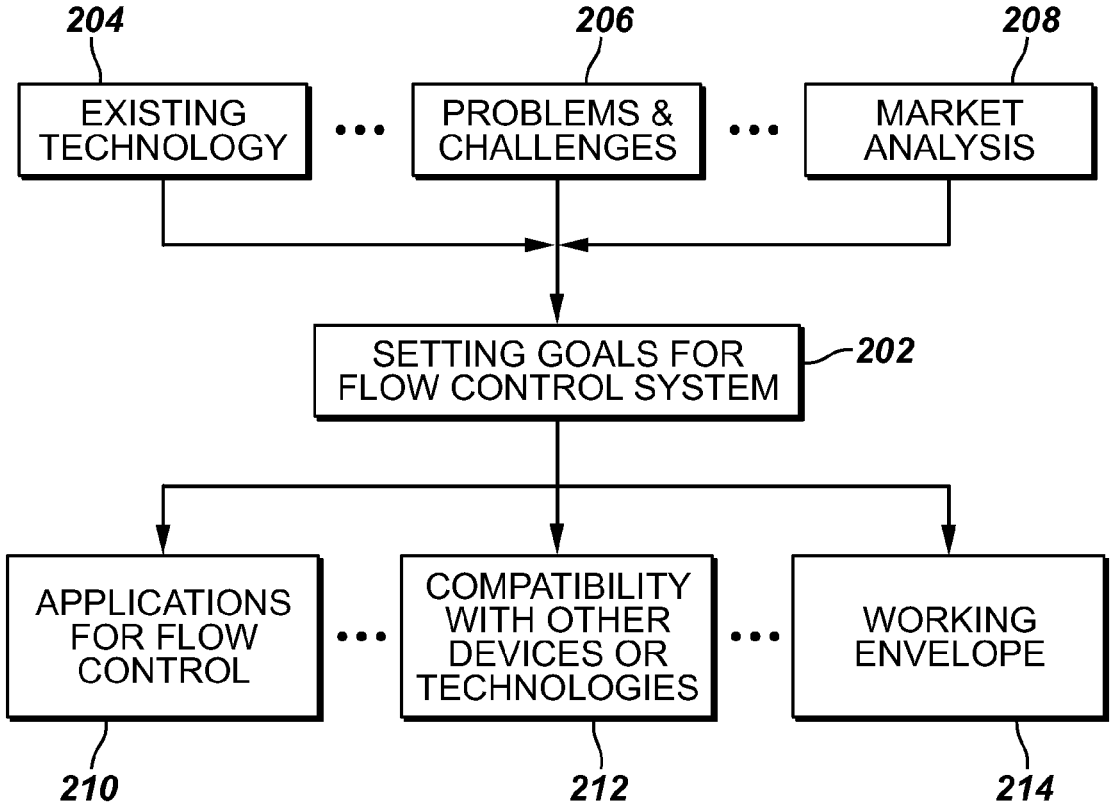
FIG. 2 is a flow diagram of tasks associated with a top level procedure of the multi-level technique of developing a flow control system, according to an embodiment.

FIG. 2 shows tasks involved in the top-level procedure, where the tasks are related to strategic decision making. To set goals (202) for the flow control system, several input factors are considered, including existing technology (204), problems and challenges (206), and market analysis (208). Existing technology (204) refers to the existing flow control technology (e.g., types of flow control devices that are currently available) and the existing applications of the flow control technology. The problems and challenges (206) describe the problems and challenges to be addressed by the flow control system to be developed. For example, the problems and challenges can include the problems and challenges associated with controlling a pressure or flow profile along a long horizontal wellbore. Market analysis (208) specifies the existing and potential markets and financial goals to be achieved by an organization that desires to deploy a flow control system. The market analysis analyzes the competition and predicts the direction of future markets and technologies related to flow control.

The goals that are set (202) in the top-level procedure based on the various input factors (204, 206, 208) include the following: applications for flow control (210), compatibility with other devices or technologies (212), and the working envelope (214). One application of flow control is inflow control, which refers to regulating the inflow of formation fluid to achieve the desired production profile (pressure profile and fluid flow rate profile) along the well. One application of inflow control is to prevent or reduce coning (either water coning or gas coning). Coning generally refers to the premature break-in of unwanted water or gas into the well for a long horizontal or highly deviated well. The frictional fluid pressure loss within the production pipe can cause the drawdown and inflow near the toe (110 in FIG. 1) to be much lower than near the heel (108 in FIG. 1). Consequently, unwanted water or gas tends to break into the well near the heel much sooner than elsewhere. Once coning occurs, the well production rate will fall dramatically and may become unprofitable.

Coning can be delayed or avoided through inflow control so that the well can work for a longer period of time to recover more hydrocarbons and generate higher profits. Other applications for flow control include any application in which a desired production profile (or an injection profile) is to be achieved. Techniques according to some embodiments can be applied to any such application.

The goal of compatibility with other devices or technologies (212) refers to integrating the flow control system with existing or future products or services. For example, the flow control system may have to be compatible with sand screens if sand control is required for the well. The size of the flow control devices may also have to be compatible with the size of a base pipe, wellbore, and so forth. Compatibility of the flow control system with other devices or technologies enables the flow control system to take advantage of existing technologies and be ready for future technologies.

The working envelope goal (214) specifies the conditions under which the flow control system will be working. The working envelope is generally represented by ranges of the following properties: properties of the reservoir(s), properties of the formation, properties of the well, properties of the formation fluid, and so forth. The working envelope is important to ensure that the flow control system being developed is not only profitable but also technically feasible.

Figure 3:
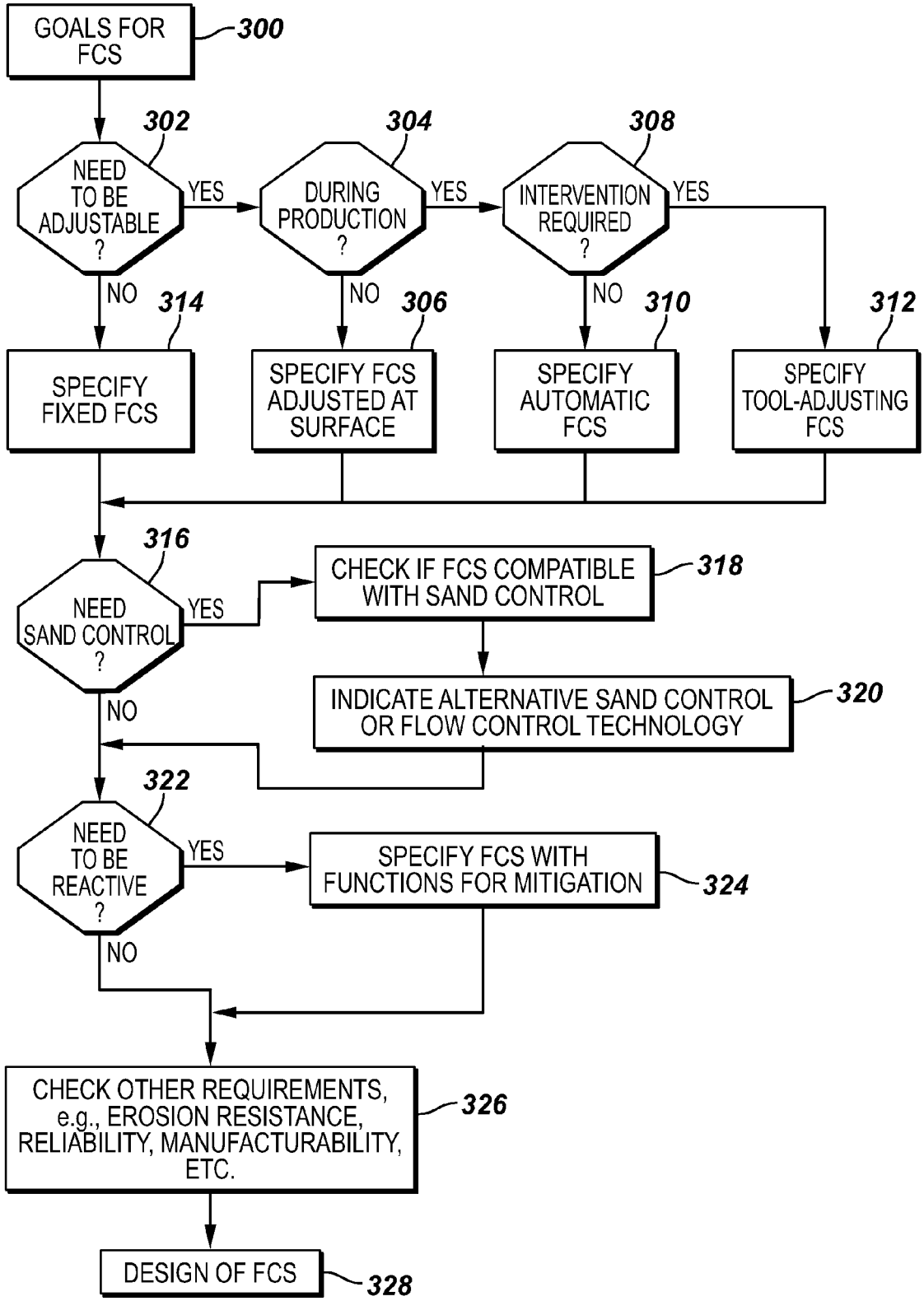
FIG. 3 is a flow diagram of tasks associated with a middle level procedure of the multi-level technique of developing a flow control system, according to an embodiment.

FIG. 3 shows the tasks involved in the middle-level procedure of the multi-level technique according to some embodiments. The input to the middle-level procedure includes the goals (300) for the flow control system (FCS) that were set by the top-level procedure, discussed in connection with FIG. 2. Based on the goals set by the top-level procedure, the middle-level procedure determines (at 302) whether the flow control system needs to be adjustable. Each flow control device of a flow control system can be adjusted to change the pressure drop across the flow control device and to adjust the flow rate through the flow control device. Note that adjustments of flow control devices can be performed at the earth surface (e.g., at the well site or at an assembly site), or the adjustments can be performed downhole. If it is determined at 302 that adjustment of the flow control system is not required, then the middle-level procedure specifies (at 314) that a fixed flow control system can be provided (in which adjustment of flow control devices in the flow control system is not possible).

On the other hand, if an adjustable flow control system is required, the middle-level procedure determines (at 304) whether adjustment of the flow control system has to be performed during production. If not, then the middle-level procedure specifies (at 306) that the flow control system can be adjusted at the earth surface (at the well site or at the assembly site).

If it is determined at 304 that adjustment should be performed during production, then the middle-level procedure determines (at 308) whether intervention is required to perform the adjustment. Note that intervention is required to adjust certain types of flow control devices, such as those flow control devices that have to be mechanically adjusted by running a shifting tool into the wellbore, or those flow control devices that have to be electrically adjusted by running a wireline tool that has an inductive coupler mechanism for electrically interacting with a mating inductive coupler mechanism associated with each flow control device. If intervention is required, as determined at 308, then the middle-level procedure specifies (at 312) an intervention tool to be used for performing the adjustment of the flow control system is defined. However, if it is determined at 308 that intervention is not required, then the middle-level procedure specifies (at 310) that the flow control devices are remotely actuatable.

The middle-level procedure also determines (at 316) whether sand control is needed. If so, then the middle-level procedure checks (at 318) if the flow control system is compatible with sand control devices and operation. If not compatible, then the middle-level procedure can indicate (at 320) that an alternative sand control technology or flow control technology has to be provided.

The middle-level procedure also determines (at 322) if the flow control system has to be reactive. A reactive flow control system is a flow control system that is able to react to a change in wellbore conditions (e.g., change in water cut or fluid flow rate). Water cut refers to the ratio of water to the total volume of fluids produced. If it is determined that the flow control system needs to be reactive, then the middle-level procedure specifies (at 324) that the flow control system should have functions for mitigation such that the flow control system can react to production of water or to change in flow rate. A flow control system with functions for mitigation include a detection mechanism (such as sensors) to detect water cut and/or flow rate.

The middle-level procedure also checks (at 326) for other requirements, including erosion resistance, reliability, manufacturability, and so forth. To satisfy such other requirements (defined by the goals 300 for the flow control system), the middle-level procedure specifies functions of the flow control system.

Finally, the middle-level procedure specifies (at 328) an overall design for the flow control system to satisfy the goals (300) set by the top-level procedure and according to the various determinations and specifications made in the tasks of FIG. 3. Note that the specified overall design covers the basic structure and working principles of a flow control system. In other words, general design options (e.g., type of flow control devices, number of flow control devices, type of actuation mechanism such as electrical, hydraulic, or mechanical actuation, auxiliary equipment such as sensors, and so forth), rather than detailed design specifications (such as specific dimension, materials, and so forth), are specified. The specified overall design of the flow control system can be selected from among several possible designs.

Figure 4:
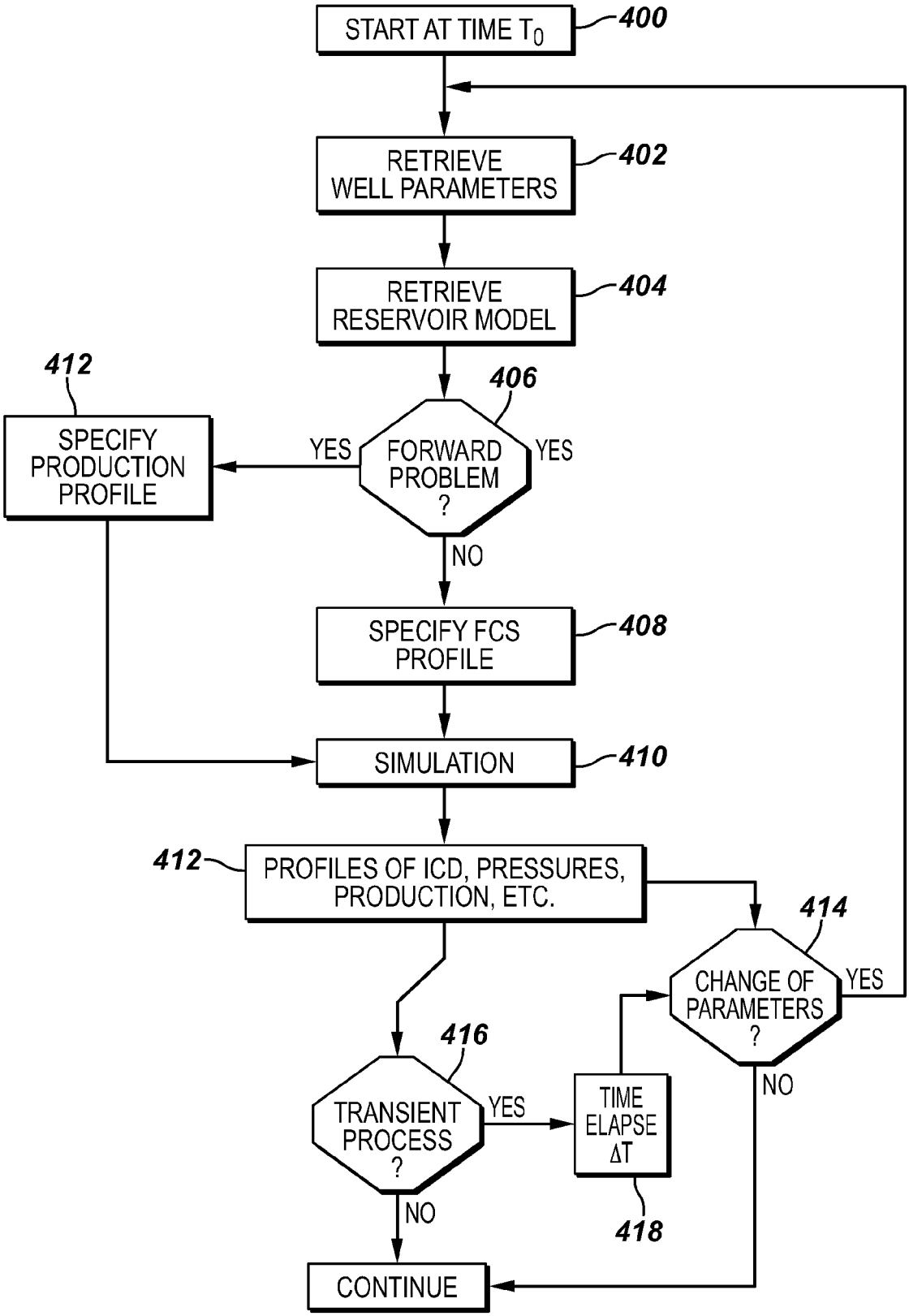
FIG. 4 is a flow diagram of tasks associated with a bottom level procedure of the multi-level technique for developing a flow control system, according to an embodiment.

FIG. 4 shows the bottom-level procedure of the multi-level technique, where the bottom-level procedure includes modeling, simulation, and testing. The bottom-level procedure starts at time To (400). Well parameters are retrieved (at 402), where the well parameters may have been obtained using logging while drilling techniques. A reservoir model is also retrieved (at 404) to enable simulation of the flow control system that has been designed by the middle-level procedure. The reservoir model can be retrieved from a reservoir database that has many models, with the models selected according to the parameters (402) of the well under consideration.

Next, the bottom-level procedure determines (at 406) whether the problem being considered is a forward problem or an inverse problem. With a forward problem, the simulation (based on the reservoir model retrieved at 404) can predict a production profile for a target flow control system design (where the target flow control system design is specified by detailed specifications for the flow control system). On the other hand, with the inverse problem, the specifications of the flow control system are calibrated for a required production profile.

If the problem is a forward problem, then the flow control system detailed specifications are specified (at 408) and simulation is performed (at 410) using the reservoir model retrieved at 404. The simulation is performed to simulate the behavior of the flow control system given the reservoir model retrieved at 404.

If the problem is an inverse problem, as determined at 406, then the bottom-level procedure specifies (at 412) the required production profile (e.g., flow rates at each zone, pressure drop at each zone, etc.). Given this production profile, simulation is performed (at 410). The output of the simulation produced (at 412) can either be the profile (detailed specifications) of the flow control system (for the inverse problem) or the production profile (for a forward problem). The production profile specifies the pressure drop across each flow control device, the flow rate across each flow control device, and so forth. More generally, a flow profile (either production or injection profile) is specified, where the flow profile includes specified pressure drops and flow rates in different zones.

Note that the reservoir model retrieved at 404 and the simulation performed at 410 can be continually modified using actual data collected during test and/or field operation as feedback. If parameters change (as detected at 414), as detected by a test or field operation, then the process at 402-412 is repeated. Note, however, if parameters do not change, then the process does not have to be repeated. The feedback is based on post-job or post-test evaluation using data collected by sensors.

Note that the bottom-level procedure can be used to simulate transient processes, such as clean-up of an invasion zone (a zone in which mud filter cake has built up). A transient process is a process that can change after some period of time. For example, when filter cake is removed from a wellbore interval, then that can cause a change in skin factor that can affect flow rate. If the bottom-level procedure determines (at 416) that the simulation is for a transient process, then the bottom-level procedure waits (at 418) for an elapsed time period. After the elapsed time period, the bottom-level procedure repeats the process at 414 and at 402-412 if parameters have changed (as determined at 414).

An example of a reservoir model that can be retrieved at 404 is described in Colin Atkinson et al., entitled "Flow Performance of Horizontal Wells with Inflow Control Devices," European J. of Applied Mathematics, pp. 409-450 (2004), which is hereby incorporated by reference. An integro-differential equation that describes the formation fluid flow is the core of the reservoir model discussed in Atkinson et al., which equation can be efficiently solved numerically:

$$\frac{1}{\pi}\int_O^L \frac{\psi(t)dt}{x-t} - \frac{d}{dx}[\Pi_F(x)\psi(x)] + a_1(x)\int_O^x \frac{\psi(t)dt}{b_1(t)} = a_2\frac{d}{dx}[b_2(x)\psi^2(x)] + a_3(x).$$

The model is able to address both forward and inverse problems at steady state. It can also be further developed to simulate transient processes, such as the cleanup of invasion zone.

Figure 5:
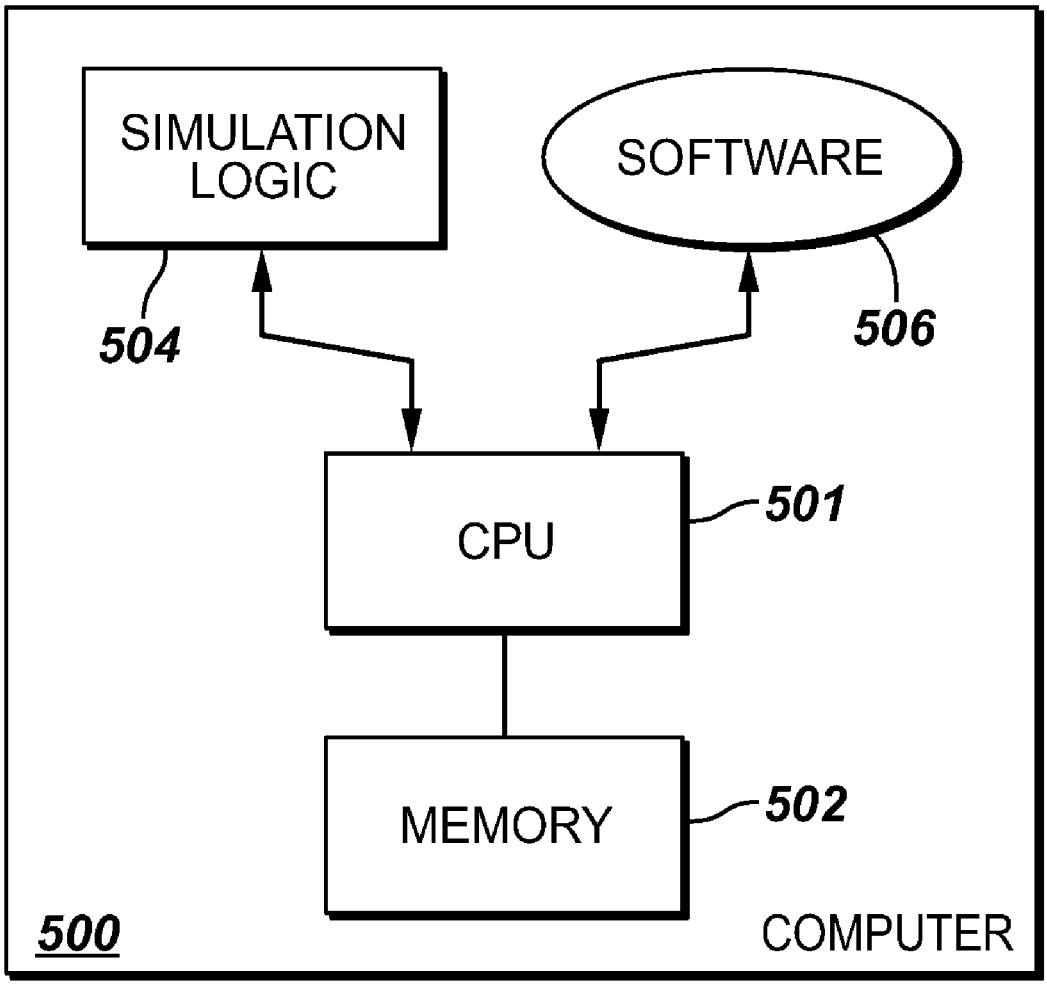
FIG. 5 is a block diagram of a computer in which software for performing some of the tasks associated with the multi-level technique is executable.

Note that at least some of the tasks described above can be automated, such as by execution in a computer. FIG. 5 shows a computer 500 that includes one or more central processing units (CPUs) 501 that are connected to memory 502. Simulation logic 504 is executable on the one or more CPUs 501, where the simulation logic 504 is used to perform the simulation at 410 in FIG. 4.

The computer 500 also includes flow control development software 506 that is able to perform one or more of the procedures (or some part of the procedures) discussed in connection with FIG. 4.

Data and instructions (of the software mentioned above) are stored in respective storage devices, which are implemented as one or more computer-readable or computer-usable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed or removable disks; other magnetic media including tape; and optical media such as compact disks (CDs) or digital video disks (DVDs).

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method of developing a flow control system for use in a well, comprising:

using a multi-level approach to develop the flow control system, wherein the multi-level approach comprises:

setting goals for the flow control system;

according to the goals set, specifying an overall design of the flow control system; and based on the specified overall design for the flow control system, simulating, by a computer, operation of the flow control system, wherein setting the goals is performed at a first level of the multi-level approach, wherein specifying the overall design for the flow control system is performed at a second level of the multi-level approach, and wherein simulating the operation of the flow control system is performed at a third level of the multi-level approach, wherein performing the third level of the multi-level approach further comprises receiving well parameters and retrieving a reservoir model according to the well parameters, and wherein simulating the operation is based on the retrieved reservoir model.

2. The method of claim 1, wherein simulating the operation of the flow control system comprises specifying a target flow profile in the well and identifying a design specification of the flow control system based on the overall design to achieve the target flow profile.

3. The method of claim 1, wherein simulating the operation of the flow control system comprises specifying a design specification of the flow control system based on the overall design and identifying a flow profile in the well that is achieved by the flow control system according to the specified design specification.

4. The method of claim 1, further comprising:

selecting one of a forward problem and an inverse problem for performing the simulating;

wherein in response to selection of the forward problem, simulating the operation of the flow control system comprises specifying a design specification of the flow control system based on the overall design and identifying a flow profile in the well that is achieved by the flow control system according to the specified design specification; and wherein in response to selection of the inverse problem, simulating the operation of the flow control system comprises specifying a target flow profile in the well and identify a design specification of the flow control system based on the overall design to achieve the target flow profile.

5. The method of claim 1, wherein setting the goals comprises specifying an application for the flow control system, specifying compatibility of the flow control system with other devices of a completion system in which the flow control system is to be incorporated, and specifying a working envelope for the flow control system.

6. The method of claim 1, wherein specifying the overall design comprises:

determining one or more of the following factors: whether the flow control system needs to be adjustable; whether sand control is needed; and whether the flow control system needs to be reactive to changing conditions in the well, and wherein the overall design is specified in response to determining the one or more factors.

7. The method of claim 1, further comprising:

determining whether simulation of the flow control system is part of a transient process; and repeating the simulation after a time interval in response to determining that the simulation is part of a transient process.

8. A method of developing a flow control system for use in a well, comprising:

specifying an overall design of the flow control system according to preset goals;

selecting one of a forward problem and an inverse problem;

in response to the selecting, simulating, by a computer, operation of the flow control system in the well in one of two different manners according to which of the forward problem and the inverse problem is selected;

receiving well parameters obtained using a logging technique; and selecting a reservoir model based on retrieved well parameters;

wherein the simulating is according to the selected reservoir model.

9. The method of claim 8, wherein, if the forward problem is selected, simulating the operation of the flow control system comprises specifying a design specification for the flow control system, and identifying a flow profile in the well based on the simulating, and wherein, if the inverse problem is selected, simulating the operation of the flow control system comprises specifying a flow profile for the well and identifying a design specification of the flow control system based on simulating the operation of the flow control system for the specified flow profile.

10. The method of claim 9, wherein the identified flow profile or specified flow profile specifies flow rates and pressure drops in respective zones of the well.

11. The method of claim 8, wherein specifying the overall design of the flow control system comprises specifying the overall design of the flow control system that is based on determining whether the flow control system needs to be adjustable, determining whether sand control is needed, and determining whether the flow control system has to be reactive to changing well conditions.

12. The method of claim 11, wherein specifying the overall design of the flow control system is further based on determining whether erosion resistance is desirable, a target reliability of the flow control system, and the target manufacturability of the flow control system.

13. The method of claim 8, further comprising:

detecting whether the well parameters have changed; and in response to detecting the change in well parameters, repeating the simulating.

14. The method of claim 13, wherein detecting that the well parameters have changed is based on feedback data provided by one of a test job and an actual job in the well.

15. The method of claim 8, wherein the flow control system comprises plural flow control devices.

16. The method of claim 1, wherein the flow control system comprises plural flow control devices.

* * * * *